United States Patent [19]

Higashino et al.

[11] Patent Number: 4,584,518

[45] Date of Patent: Apr. 22, 1986

[54] CIRCUIT FOR TRANSMITTING ENERGY TO AND FROM COILS

[75] Inventors: Shigenori Higashino; Yoshiro Shikano; Kanji Katsuki, all of Hyogo, Japan

[73] Assignee: Mitsubishi Denki Kabushiki Kaisha, Tokyo, Japan

[21] Appl. No.: 473,405

[22] Filed: Mar. 9, 1983

[30] Foreign Application Priority Data

Mar. 9, 1982 [JP] Japan ..... 57-38914

[51] Int. Cl.[4] ..... G05F 1/00

[52] U.S. Cl. ..... 323/224; 320/1; 363/14

[58] Field of Search ..... 320/1; 363/14, 124, 363/37; 307/19, 21, 45, 109; 323/222, 224

[56] References Cited

U.S. PATENT DOCUMENTS 4,135,236 1/1979 Mann et al. ..... 363/124
4,257,092 3/1981 Prines et al. ..... 363/124

FOREIGN PATENT DOCUMENTS 54-51399 4/1979 Japan ..... 363/14
444172 4/1975 U.S.S.R. ..... 323/222
855893 8/1981 U.S.S.R. ..... 363/124

OTHER PUBLICATIONS

Kustom, Robert L., "Comparison of Flying Capacitor Bridge Circuits and Inductor-Convertor Bridge Circuits for the Transfer of Energy Between Superconducting Coils," *Superconductive Energy Storage,* Oct. 10, 1979.

Ueda, K., et al., "Energy Transfer Experiment with Flying Capacitor Circuit," *Superconductive Energy Storage,* Oct. 10, 1979.

Fuja, Raymond E., et al., "Three-Phase Energy Transfer Circuit with Superconducting Energy Storage Coils," *1980 IEEE.*

*Primary Examiner*—Peter S. Wong
*Assistant Examiner*—Judson H. Jones
*Attorney, Agent, or Firm*—Sughrue, Mion, Zinn, Macpeak and Seas

[57] ABSTRACT

A circuit for transmitting energy to and from coils is improved by connecting a coil to a bridge circuit composed of a diode and a switch such as a gate turn-off thyristor. An opposite polarity switch and diode construction may be used in addition to selectively allow the direction of current flow through the coil to be reversible.

5 Claims, 35 Drawing Figures

Vc
0
Vc MAX iD21
0

V1
0 iS52
0

V2
0
②
③
④
Δt

1
+
−
201
21
12
30
11
22
CONTROL CIRCUIT
81
201
21
12
30
11
22
CONTROL CIRCUIT
81

Id
ID21
ID22
IS11
IS12
IL
0
0
0
0
0
0
Δt

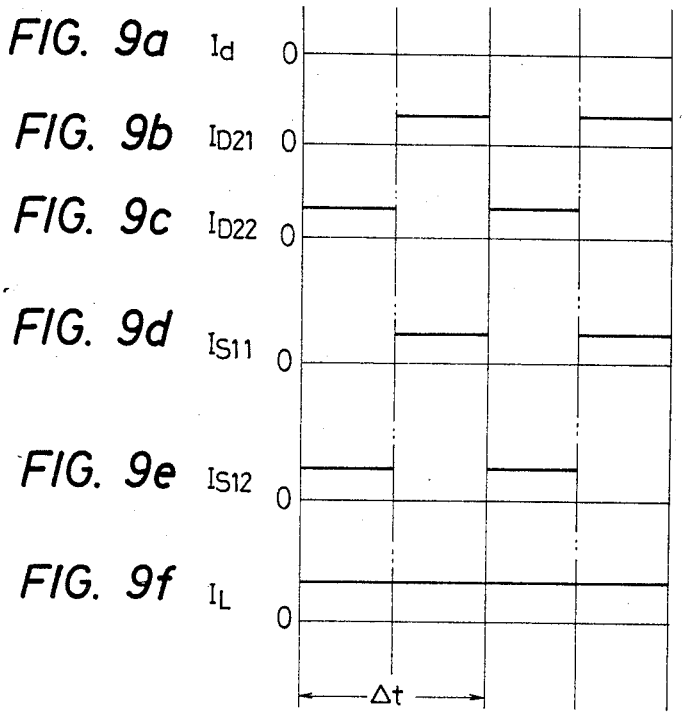
FIG. 10
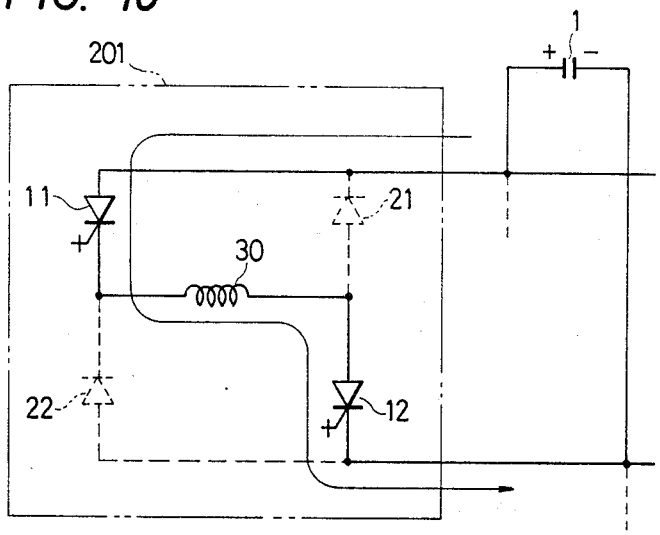

Id
0

ID21
0

ID22
0

IS11
0

IS12
0

IL
0
Δt

CIRCUIT FOR TRANSMITTING ENERGY TO AND FROM COILS

BACKGROUND OF THE INVENTION

This invention relates to a circuit for transmitting energy to and from coils, or for transmitting the energy stored in a coil to another coil through a capacitor.

FIG. 1 illustrates a circuit of this type, as disclosed in copending U.S. application Ser. No. 473,408, entitled, "Apparatus for Transmitting Energy To and From Coils" filed, Mar. 9, 1983, commonly assigned, the disclosure of which is hereby incorporated by reference. In FIG. 1, there is shown a circuit comprising a capacitor 1 used in single polarity, diodes 21, 22, a coil 31 for releasing energy, a coil 41 for absorbing energy, self-controllable on-off switches 51, 52, a circuit 81 for controlling the flow rate of the current to control the on-off operation of the switch 51 to make the voltage of the capacitor 1 constant, and a circuit 82 for controlling the flow rate of the current by turning on and off the switch 52.

The operation of the circuit shown in FIG. 1 will now be described. FIGS. 2(1)–2(4) show the operating modes of the switches 51, 52 and the directions of the current flowing in the circuit making it clear that there are four kinds of operating modes. FIGS. 3(*a*)–(*e*) illustrate an example of the waveform of each component when Δt is set as a time controlling interval. FIGS. 3(*a*)–(*e*) show the voltage Vc across the terminals of the capacitor 1, the waveform $i_{D21}$ of the current drawn by the diode 21, the voltage V1 across the terminals of the coil 31, the waveform $i_{S52}$ of the current drawn by the switch 52, and voltage V2 across the terminals of the coil 41, respectively.

In FIG. 1, the switch 51 is controlled in such a way that the flow rate of the current therein is regulated by the control circuit 81 to make the voltage across the terminals of the capacitor 1 constant and such that it is turned on and off at preset time intervals. On the other hand, the flow rate of the current directed into the switch 52 is regulated by the control circuit 82 so that it is turned on and off at preset time intervals and operates to control the voltage applied to the coil 41 according to the quantity of the energy transmitted to the coil 41.

Since the circuit shown in FIG. 1 is constructed as above, it has disadvantages such that the transmission of energy between coils is unidirectional and such that, when a coil with less energy loss, including a superconductive coil or the like, is used as a load, energy must be consumed by an energy releasing circuit (not shown) each time the operation of the coil 41 is terminated; the problem is that the direction of the current flowing through the coil is unidirectional only.

SUMMARY OF THE INVENTION

The present invention has been made in light of the above problems, and an object of the invention is to provide a circuit in which it is made possible to transmit energy to and from coils by connecting a coil to a bridge circuit comprising a diode and an on-off self-controllable switch. Another object is to provide a new circuit capable of controlling the current flowing through the coil so as to make its direction reversible.

DETAILED DESCRIPTION OF THE PREFERRED EMBODIMENTS

Figure 1:
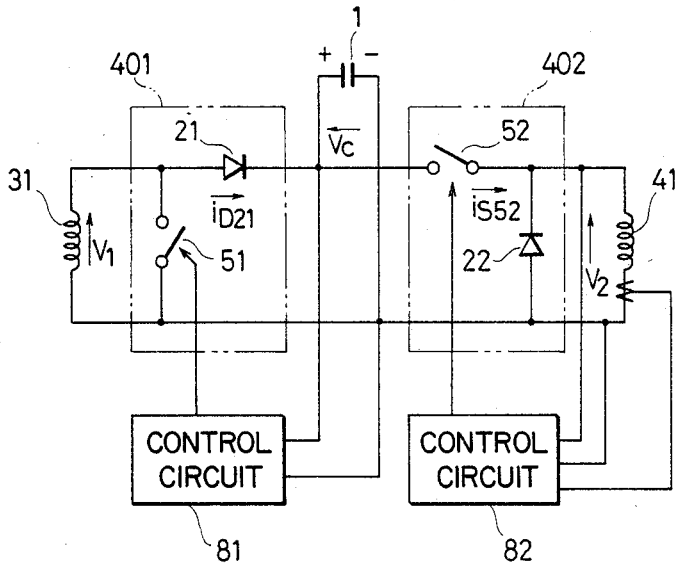
FIG. 1 is a circuit configuration illustrating a device similar to the present invention.
Figure 2A:
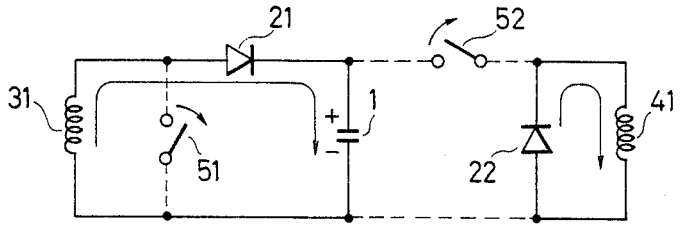
FIGS. 2(1)–(4) are charts of operating modes explanatory of the operation of the device of FIG. 1.
Figure 2B:
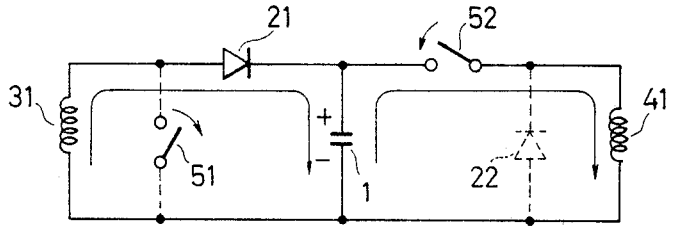
Figure 2C:
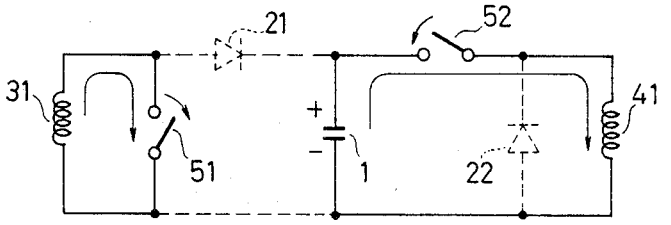
Figure 2D:
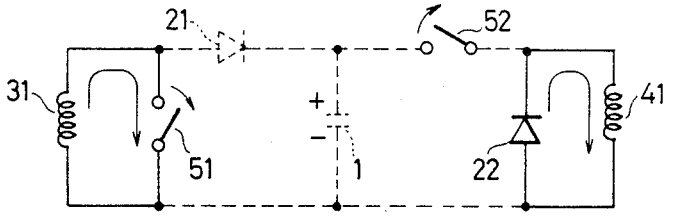
Figures 3A, 3B, 3C, 3D, 3E:
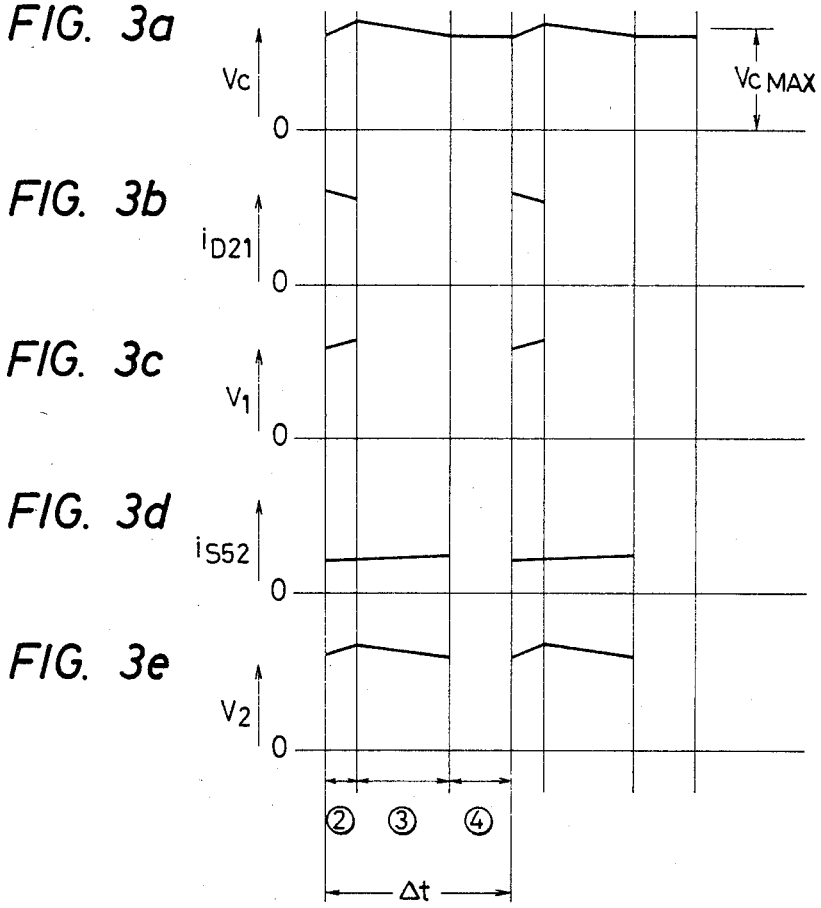
FIGS. 3(*a*)–(*e*) are waveform charts illustrating the change of the voltage or current in each component in FIG. 1.
Figure 4:
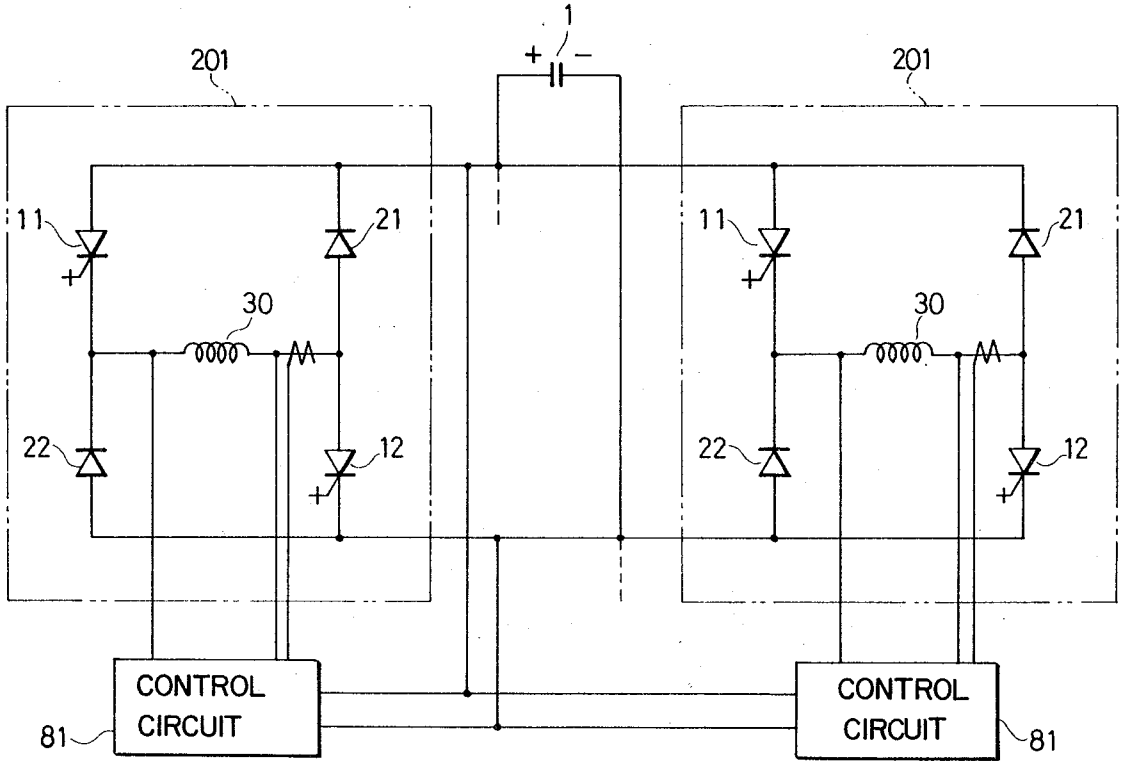
FIG. 4 is a circuit configuration of an example of the present invention.

Referring now to FIG. 4, an example of the present invention will be described. In FIG. 4, the circuit comprises a capacitor 1 used in single polarity, gate turn-off thyristors 11, 12 used as on-off self-controllable switches, diodes 21, 22, and a coil 30 for transmitting energy. In addition, there are shown circuits 81 for regulating the flow rate of the current flowing through the on-off self-controllable switches 11, 12, and a principal portion 201 of the circuit for transmitting energy.

The operation of the circuit in the above example will now be described. The operation of releasing energy from the coil 30 is conducted by simultaneously turning off the switches 11, 12, whereas that of absorbing the energy into the coil 30 is conducted by simultaneously turning on the switches 11, 12. The operation of maintaining the energy is carried out by alternately turning the switches 11, 12 on and off. The control of the quantity of the energy to be transmitted in each operation is conducted by controlling the flow rate of the current flowing through the switches 11, 12.

Figure 5:
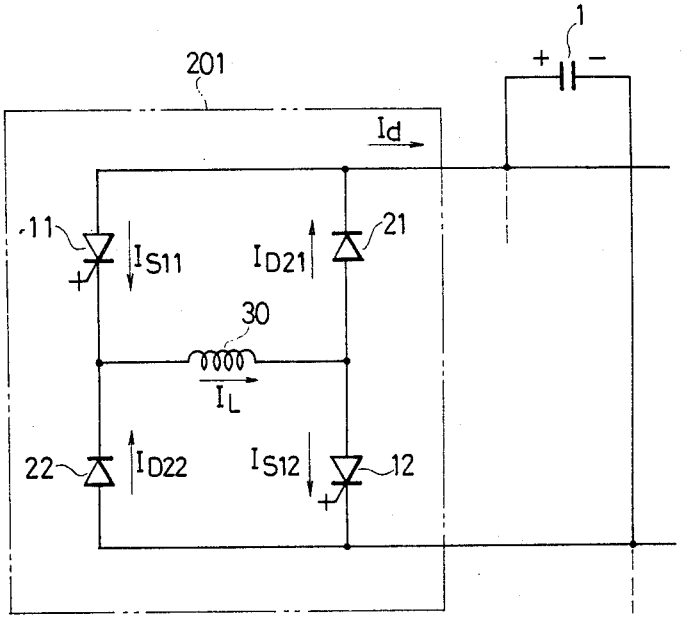
FIG. 5 is a principal circuit diagram illustrating the flow of current in FIG. 4.

FIG. 5 illustrates the direction of the current in a circuit employed for describing circuit operation; the current flowing through the switches 11, 12 are represented by $I_{S11}$, $I_{S12}$ and that flowing through the diodes 21, 22 by $I_{D21}$, $I_{D22}$. The current flowing toward the capacitor 1 from the circuit 201 is given by Id. Although the circuit on the lefthand side of FIG. 4 is used to describe FIG. 5, the righthand circuit of FIG. 4 is identical to the left-hand one.

Figure 6:
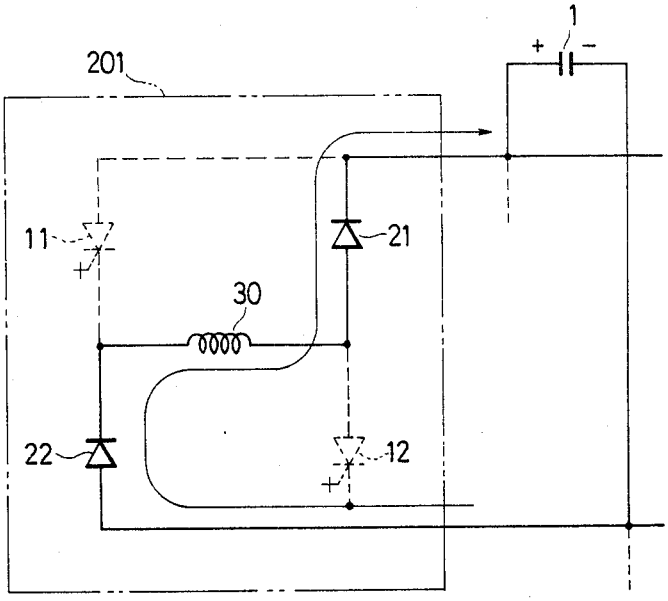
FIGS. 6, 8(1)–(2) and 10 are charts of operating modes explanatory of the operations of the device of FIG. 4.
Figures 7A, 7B, 7C, 7D, 7E, 7F:
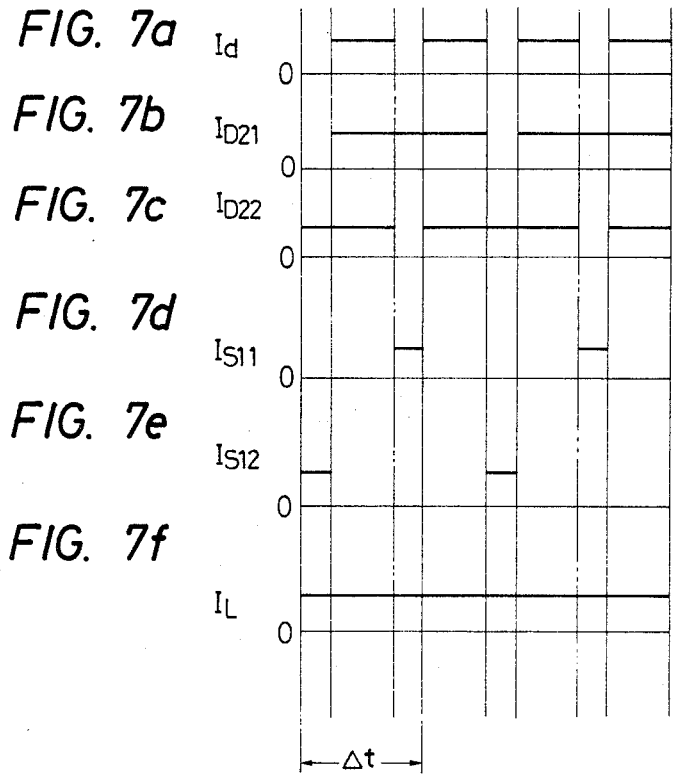
FIGS. 7(*a*)–(*f*), 9(*a*)–(*f*) and 11(*a*)–(*f*) are waveform charts illustrating the change of the voltage or current in each component in FIG. 4 according to control with different current flow rates, respectively.

FIG. 6 shows a current route in the mode of releasing energy from the coil 30, whereas FIGS. 7(*a*)–(*f*) indicate the waveform of the current in each component in FIG. 5 when the flow rate of the current flowing through the switches 11, 12 is regulated to reduce it to less than 50%.

Figure 8:
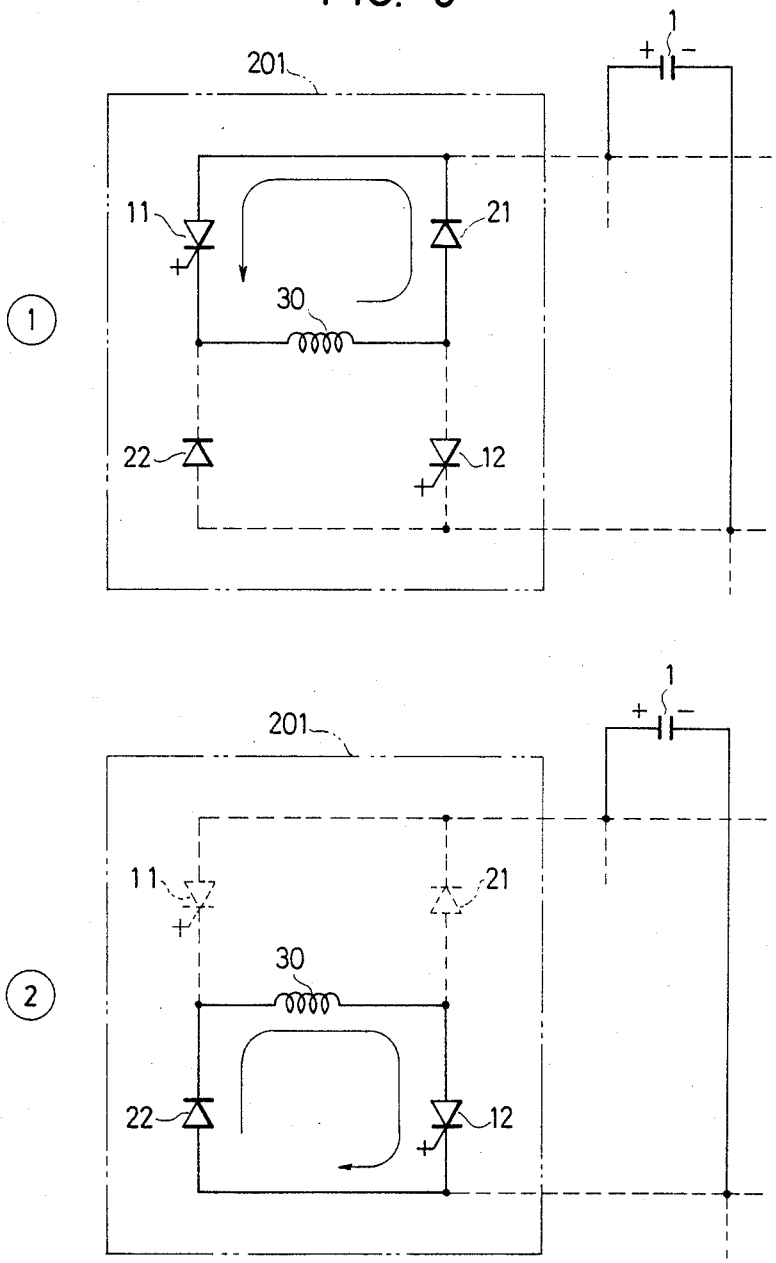

FIGS. 8(1) and 8(2) show current routes in the mode of holding energy in the coil 30, whereas FIGS. 9(*a*)–(*f*) indicate the waveforms of the current in each component when the flow rate of the current flowing through the switches 11, 12 is regulated to make it remain at 50%.

Figures 11A, 11B, 11C, 11D, 11E, 11F:
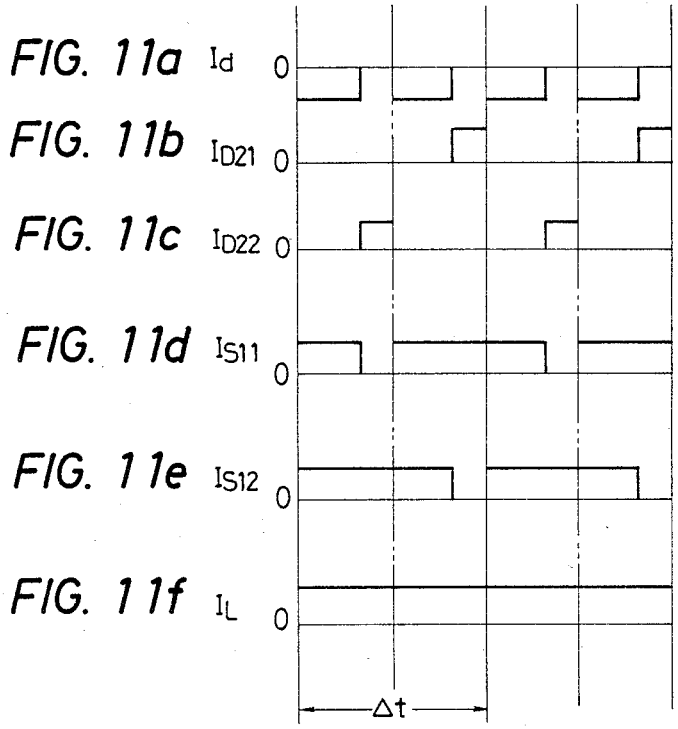

FIG. 10 refers to a current route in the mode of absorbing energy in the coil, whereas FIG. 11 shows the waveform of the current in each component when the flow rate of the current flowing through the switches 11, 12 is regulated to reduce it to more than 50%.

In the meantime, the switches 11, 12 which are connected to the coil which is releasing energy are controlled by the control circuits 81 in terms of the current flow rate in a manner such that the voltage across the terminals of the capacitor 1 is maintained at a constant value.

Moreover, the switches 11, 12 connected to the coil which is absorbing energy are controlled by the control circuits 81 such that the flow rate of the current is proportional to the quantity of energy to be transmitted.

In the case of the energy holding mode, the switches 11, 12 are operated in a manner such that they are repeatedly alternately turned on and off at the flow rate of 50%.

As described above, the circuit shown in FIG. 4 is capable of releasing, holding and absorbing energy using one type of circuit configuration.

Although reference has generally been made to only the lefthand circuit of FIG. 4, operations are obviously conducted in the righthand circuit so as to cause energy to be transmitted to and from the coils 30.

Figure 12:
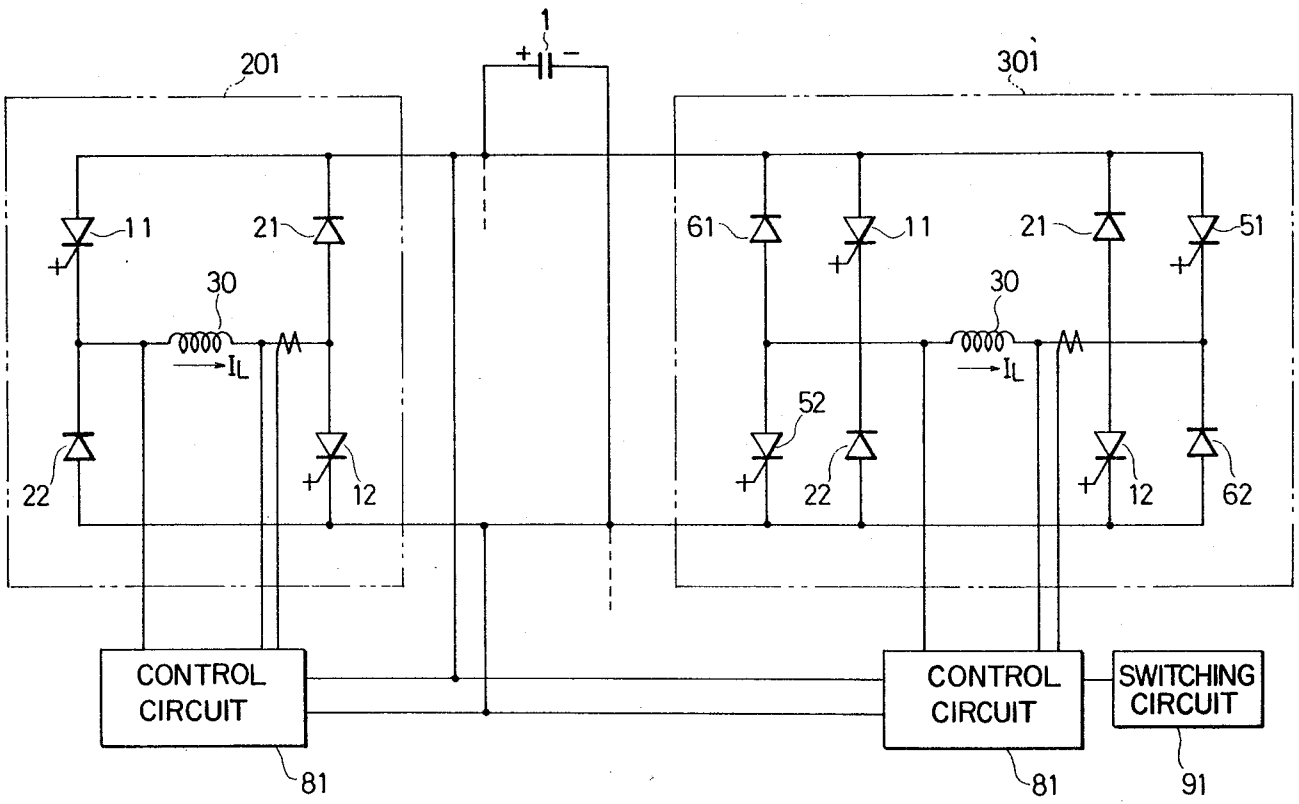
FIGS. 12 and 13 show a circuit configuration illustrating another example of the present invention.

FIG. 12 illustrates an example of a further circuit in which the direction of the current flowing through the coil can be controlled to make it reversible.

FIG. 12 illustrates an example of the energy transmitting circuit 201 described previously, and an example of a further circuit 301 capable of controlling the direction of the current flowing through the coil so as to make it reversible.

The device of FIG. 12 employs gate turn-off thyristors 11, 12, 51, 52 employed as on-off self-controllable switches, diodes 21, 22, 61, 62, a coil 30 for transmitting energy, a control circuit 81 for controlling the on-off self-controllable switches 11, 12, 51, 52, and a switching circuit 91 for switching the control signals to be applied to the on-off self-controllable switches depending on the direction of the current flowing through the coil.

The operation of this circuit will now be described. In the circuit 301 shown in FIG. 12, when the direction of the current $I_L$ flowing through coil 30 coincides with that shown in the drawing, the operations of releasing, holding and absorbing energy from and into the coil 30 are carried out depending upon the manner of the control of the current flow by the on-off operation of the on-off self-controllable switches 11, 12, and the waveforms of the current in each component in operation is the same as in the case of the circuit 201. At this time, the switches 51, 52 and diodes 61, 62 will not operate as circuit elements constituting part of the current route, and the switches 51, 52 are controlled so that they are left open by the switching circuit 91.

In addition, when the direction of the current flowing through the coil 30 is opposite to that shown in the drawing, the switches 11, 12 and diodes 21, 22 of the circuit 301 will not operate as circuit elements constituting part of the current route, but the circuit will operate in such a manner that the switches 51, 52 and diodes 61, 62 constitute the current route, whereas the switches 11, 12 are controlled so that they are left open by the switching circuit 91.

In this case, the switches 51, 52 are turned on and off with the same current flow rate control applicable to the switches 11, 12 when the former operates to release, hold and absorb energy in the coils.

Thus the circuit 301 in FIG. 12 operates to make it possible to release, hold and absorb energy as well as to reverse the direction of the current flowing through the coil, using only one circuit configuration.

In the above examples, although gate turn-off thyristors have been employed as the on-off self-controllable switches 11, 12, chopper circuits composed of thyristors, transistors, reverse conducting thyristors and the like which are on-off self-controllable and are provided with equivalent functions may be used in place of the gate turn-off thyristors.

Figure 13:
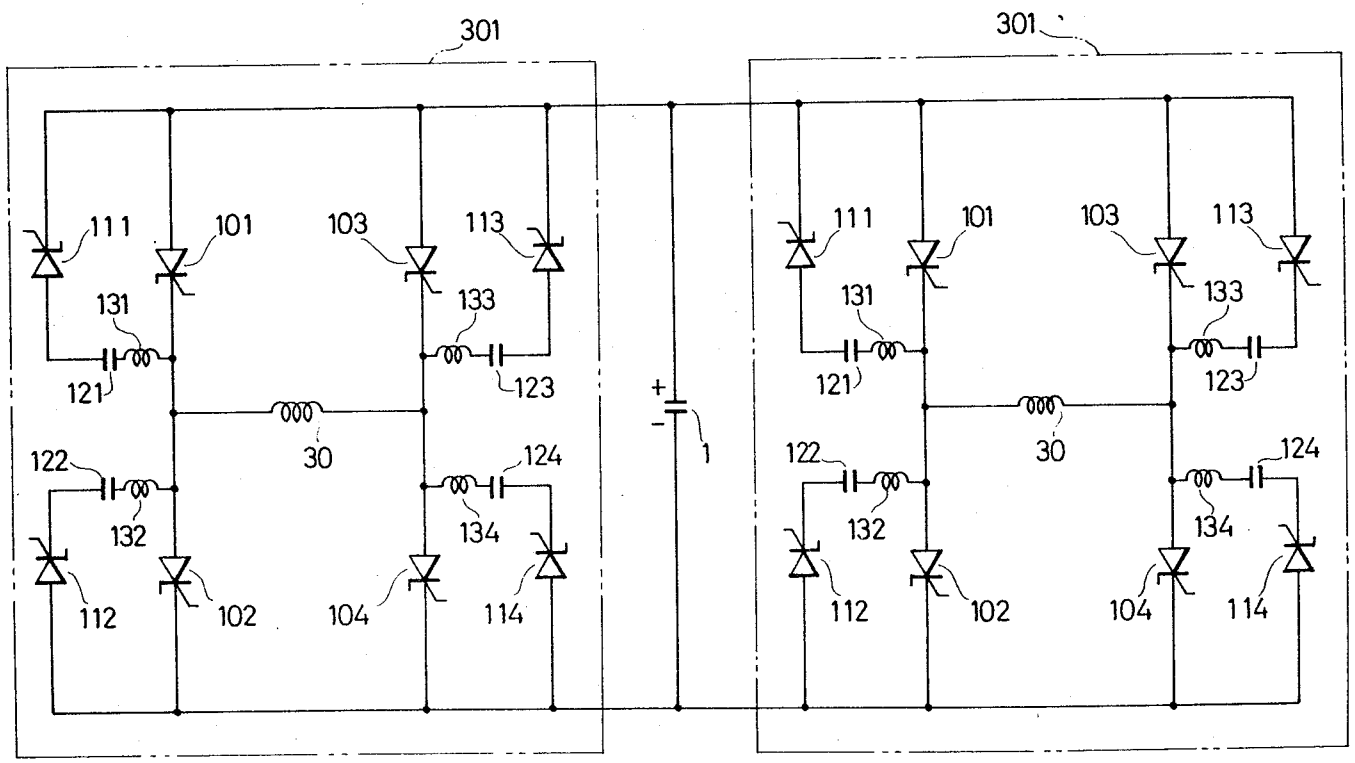

FIG. 13 illustrates another example employing reverse conducting thyristors, wherein the drawing shows reverse conducting thyrsitors 101, 102, 103, 104, commutation reverse conducting thyristors 111, 112, 113, 114, commutation capacitors 121, 122, 123, 124, and commutation reactors 131, 132, 133, 134; excluding these components, this circuit is constructed in the same way as the above examples.

Although only one energy releasing coil and one energy absorbing coil are employed in each of the above examples, a plurality of the same in one or both cases above, with a capacitor for their common use, may be employed.

The transmission of energy in either direction between coils is thus made possible in the circuit for transmitting energy to and from coils according to the present invention, and, because the operating frequency of the circuit becomes twice as large as the on-off frequency of the on-off self-controllable switch, a ripple in the voltage across the terminals of the capacitor is reduced, so that the capacitance of the capacitor may be selected at a small value.

Moveover, because the capacitor voltage is controlled so that it is made constant, it becomes possible to transmit energy to and from equipment other than coils using a constant voltage.

Furthermore, a modified version of the present invention can control the direction of the current flowing through the coil so as to made the same reversible.

What is claimed is:

1. A circuit for transmitting energy to and from coils, comprising; a capacitor, a first transmitting circuit and a second transmitting circuit coupled in parallel with respect to each other, each of said transmitting circuits including first and second series circuits each having a switch and a diode, each of said transmitting circuits being completed by connecting one end of a coil to a point at which the switch and diode in said first series circuit have been connected together, and connecting the other end of said coil to a point where the switch and diode in said second series circuit have been connected together, in order to release energy through an array including a diode and to absorb energy through an array including a switch and a coil, means for controlling the quantity of the energy transmitted to the coil so as to make constant the current and polarity of said capacitor, said controlling means including means controlling the on-off operation of the switch in said first transmitting circuit and the on-off operation of the switch in said second transmitting circuit.

2. A circuit as claimed in claim 1, wherein said switches comprise gate turn-off thyristors.

3. A circuit as claimed in claim 1, wherein said switches comprise chopper circuits, the flow rate of the current in said chopper circuit being controlled.

4. A circuit as claimed in claim 2, including a further circuit connected to a diode in a manner such that the polarity thereof is reversed, a further diode being connected to said circuit in a manner such that the polarity thereof is reversed, whereby the direction of the current flowing into said coil can be controlled so as to make the direction reversible.

5. A circuit as claimed in claim 1, wherein a plurality of said first transmitting circuits and second transmitting circuits are provided and connected to a common capacitor, whereby energy can be mutually transmitted to and from a plurality of coils.

* * * * *